US010513129B2

(12) United States Patent
Chiu

(10) Patent No.: US 10,513,129 B2
(45) Date of Patent: Dec. 24, 2019

(54) TRAY DRAWER AND MULTI-FUNCTION PRINTER USING THE SAME

(71) Applicant: AVISION INC., Hsinchu (TW)

(72) Inventor: Chin-Chu Chiu, Hsinchu County (TW)

(73) Assignee: AVISION INC., Hsinchu (TW)

( * ) Notice: Subject to any disclaimer, the term of this patent is extended or adjusted under 35 U.S.C. 154(b) by 0 days.

(21) Appl. No.: 15/842,971

(22) Filed: Dec. 15, 2017

(65) Prior Publication Data

US 2018/0194147 A1 Jul. 12, 2018

(30) Foreign Application Priority Data

Jan. 12, 2017 (TW) ..... 106101004 A

(51) Int. Cl.

| | |
|---|---|
| ***B41J 11/58*** | (2006.01) |
| ***G03G 15/00*** | (2006.01) |
| ***B65H 1/04*** | (2006.01) |
| ***B65H 1/26*** | (2006.01) |
| ***B41J 11/00*** | (2006.01) |

(52) U.S. Cl.

CPC ..... *B41J 11/0075* (2013.01); *B41J 11/58* (2013.01); *B65H 1/04* (2013.01); *B65H 1/266* (2013.01); *G03G 15/6511* (2013.01); *G03G 15/6514* (2013.01); *B65H 2402/63* (2013.01); *B65H 2551/23* (2013.01)

(58) Field of Classification Search

CPC ..... B41J 11/0075; B41J 11/64

See application file for complete search history.

(56) References Cited

U.S. PATENT DOCUMENTS

| | | | | |
|---|---|---|---|---|
| 3,906,355 | A * | 9/1975 | Watanabe | B41J 2/215 101/DIG. 37 |
| 2013/0001871 | A1* | 1/2013 | Chen | B65H 7/02 271/265.01 |
| 2013/0161899 | A1* | 6/2013 | Ito | B65H 1/266 271/147 |
| 2013/0228962 | A1* | 9/2013 | Kimura | B65H 1/00 271/18 |
| 2015/0239265 | A1* | 8/2015 | Lo | B41J 11/58 347/104 |

(Continued)

FOREIGN PATENT DOCUMENTS

| | | |
|---|---|---|
| CN | 2170429 Y | 6/1994 |
| CN | 1351543 A | 5/2002 |
| CN | 1484113 A | 3/2004 |

(Continued)

OTHER PUBLICATIONS

Machine generated, English translation of JP2008133061 to Mizuguchi, "Paper Feeder"; retrieved via espacenet.com on Jun. 6, 2019; 20pp.*

(Continued)

*Primary Examiner* — Shelby L Fidler
(74) *Attorney, Agent, or Firm* — WPAT, PC

(57) ABSTRACT

A tray drawer and a multi-function printer using the same are provided. The tray drawer includes a drawer body, a tray and an indicating mechanism. The tray is disposed within the drawer body. The indicating mechanism includes an indicator and a linkage. The linkage pivotally connects the indicator and a lateral surface of a front end of the tray.

8 Claims, 5 Drawing Sheets

(56) References Cited

U.S. PATENT DOCUMENTS

2017/0003635 A1* 1/2017 Koga ..... G03G 15/6511

FOREIGN PATENT DOCUMENTS

| | | | |
|---|---|---|---|
| CN | 201051410 | Y | 4/2008 |
| CN | 201082835 | Y | 7/2008 |
| CN | 202608221 | U | 12/2012 |
| CN | 203210041 | U | 9/2013 |
| JP | 58144035 | A | 8/1983 |
| JP | 2006137561 | A | 6/2006 |
| JP | 2008133061 | | 6/2008 |
| TW | 288388 | | 10/1996 |
| TW | 584072 | | 4/2004 |

OTHER PUBLICATIONS

Taiwan Intellectual Property Office, "Office Action" dated Oct. 24, 2017, Taiwan.
Office action issued by State Intellectual Property Office of the People's Republic of China dated Feb. 3, 2019.
Office action issued by China National Intellectual Property Administration dated Aug. 14, 2019.

* cited by examiner

TRAY DRAWER AND MULTI-FUNCTION PRINTER USING THE SAME

This application claims the benefit of Taiwan application Serial No. 106101004, filed Jan. 12, 2017, the disclosure of which is incorporated by reference herein in its entirety.

TECHNICAL FIELD

The disclosure relates in general to a tray drawer and a multi-function printer using the same, and more particularly to a tray drawer having an indicating mechanism and a multi-function printer using the same.

BACKGROUND

The generally known multi-function printer includes a tray drawer for carrying paper. The multi-function printer prints an image on the paper grasped from the tray drawer. When a user wants to know how much paper is left within the tray drawer, the user has to pull out the tray drawer. However, such practice requires an additional movement, and is inconvenient.

Therefore, how to enable the user to quickly and conveniently know how the quantity of the paper left within the tray drawer has become a prominent task for any person ordinarily skilled in the technology field of the invention.

SUMMARY

The disclosure is directed to a tray drawer and a multi-function printer using the same capable of resolving the generally known problems.

According to one embodiment, a tray drawer is provided. The tray drawer includes a drawer body, a tray and an indicating mechanism. The tray is disposed within the drawer body. The indicating mechanism includes an indicator and a linkage. The linkage pivotally connects the indicator and the tray.

According to another embodiment, a multi-function printer is provided. The multi-function printer a printer body and a tray drawer. The tray drawer is disposed within the printer body.

According to another embodiment, a tray drawer is provided. The tray drawer includes a tray and an indicating mechanism. The indicating mechanism displays the height level of one end of the tray. The indicating mechanism includes a linkage and a slider. The linkage includes a first end and a second end. The first end is connected to the slider, and the second end is connected to the tray. The linkage has a fulcrum for actuation nearer to the slider.

The above and other aspects of the invention will become better understood with regard to the following detailed description of the preferred but non-limiting embodiment (s). The following description is made with reference to the accompanying drawings.

DETAILED DESCRIPTION

Figure 1:
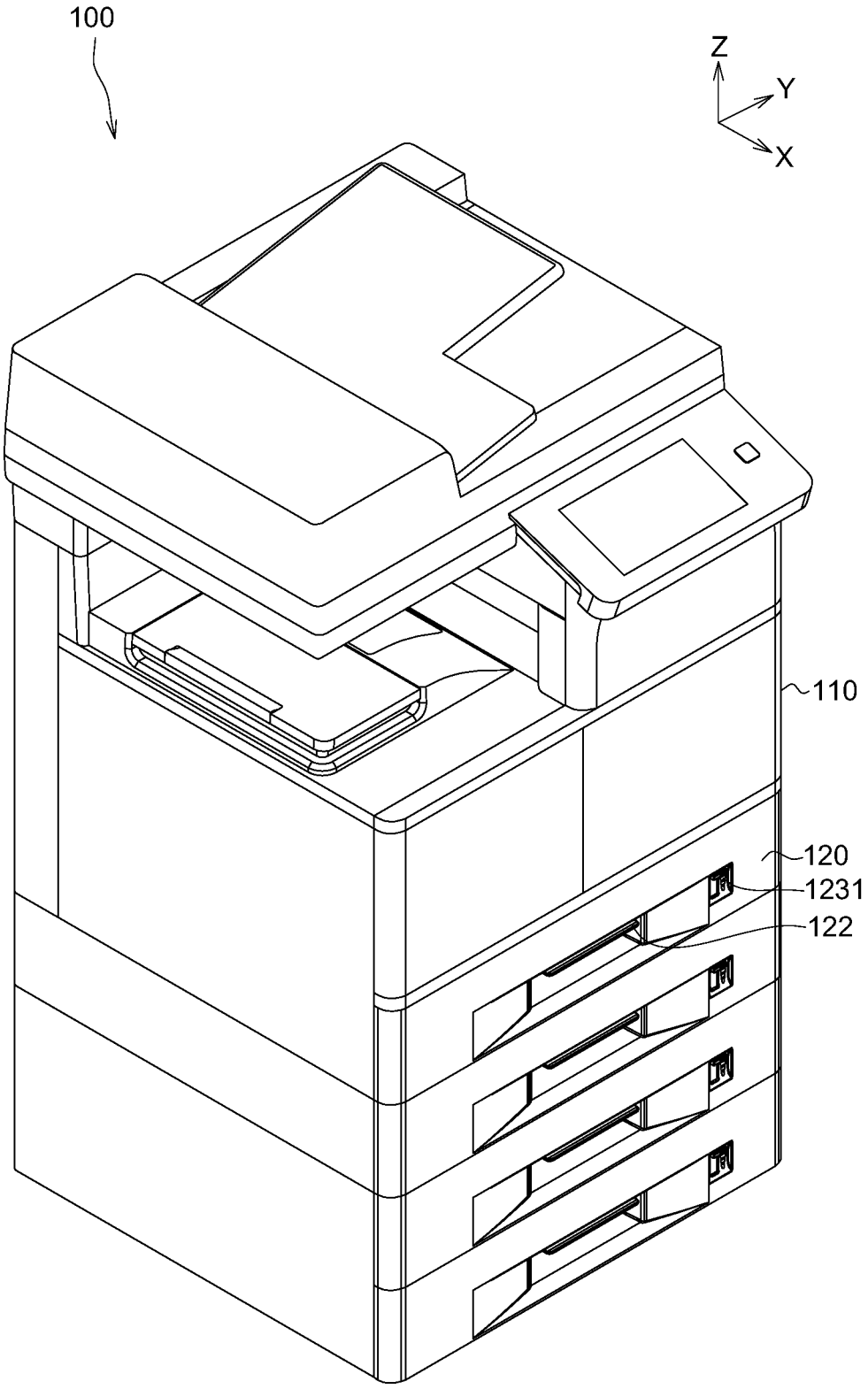
FIG. 1 is an external view of a multi-function printer according to an embodiment of the invention.
Figure 2:
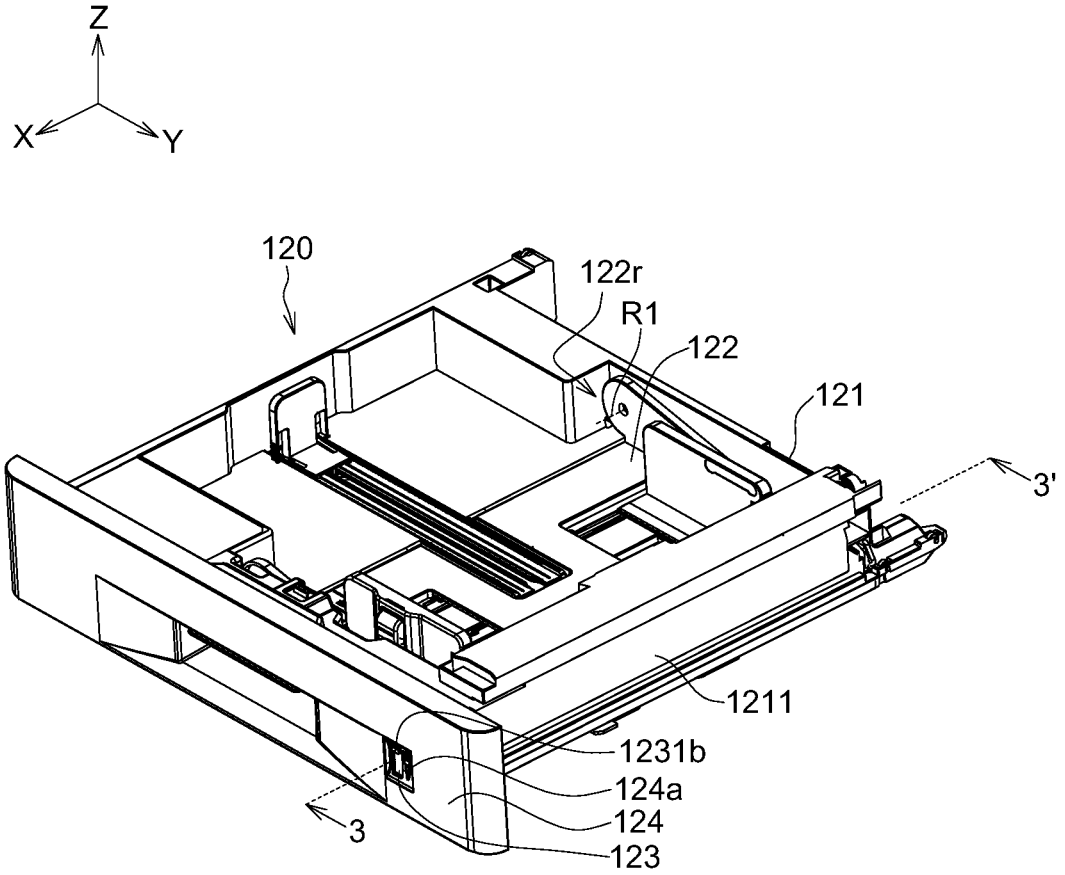
FIG. 2 is a schematic diagram of the indicator of the tray drawer of FIG. 1 indicating a high quantity.
Figure 3:
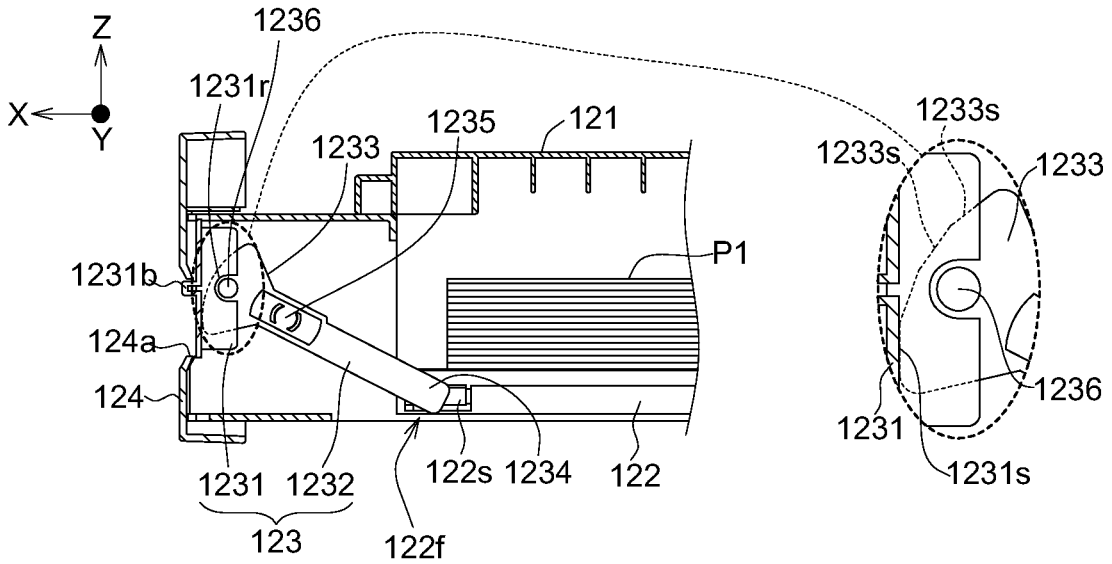
FIG. 3 is a cross-sectional view of the tray drawer of FIG. 2 along a direction 3-3'.

Refer to FIGS. 1-3. FIG. 1 is an external view of a multi-function printer 100 according to an embodiment of the invention. FIG. 2 is a schematic diagram of the indicator 1231 of the tray drawer 120 of FIG. 1 indicating a high quantity. FIG. 3 is a cross-sectional view of the tray drawer 120 of FIG. 2 along a direction 3-3'.

As indicated in FIG. 1, the multi-function printer 100 has the printer body 110 and the tray drawer 120. The tray drawer 120 can be slidably disposed within the printer body 110. When the printer has run of paper, the tray drawer 120 can be pulled out and filled up.

The tray drawer 120 includes a drawer body 121, a tray 122 and an indicating mechanism 123. The tray 122 is disposed within the drawer body 121 for carrying the paper P1. The indicating mechanism 123 includes an indicator 1231 and a linkage 1232. The linkage 1232 pivotally connects the indicator 1231 and a lateral surface 122*s* of a front end 122*f* of the tray 122. The linkage 1232 can pivotally connect a front surface of the tray 122 towards the +X axis or pivotally connect a lower surface of the tray 122 towards the −Z axis. As indicated in FIG. 3, the linkage 1232 includes a first end 1233 and a second end 1234. The first end 1233 pivotally connects the indicator 1231, and the second end 1234 pivotally connects the tray 122. The quantity of the paper P1 loaded on the tray 122 determines the height level of the tray 122. Through the linkage 1232, the height level of the indicator 1231 can be changed to indicate the quantity of the paper P1 loaded on the tray 122.

The front end 122*f* is one end of the tray drawer 120 towards the pulling out direction such as the +X axis. The lateral surface 122*s* is a surface of the tray drawer 120 towards a lateral side such as towards the +/−Y axis.

As indicated in FIG. 2, the rear end 122*r* of the tray 122 pivotally connects the drawer body 121 and can rotate around the shaft R1. The front end 122*f* of the tray 122 is far away from the shaft R1 disposed at the rear end 122*r*. Therefore, when the tray 122 rotates around the shaft R1 disposed at the rear end 122*r*, the upward or downward movement of the front end 122*f* has a longer course, and the indicator 1231 can provide a longer indicating course for the user to observe more changes in paper quantity.

As indicated in FIG. 2, the drawer body 121 includes a front plate 124 having an indicating hole 124*a*. The indicating portion 1231*b* of the indicator 1231 is exposed from the indicating hole 124*a* for allowing the user to know the quantity of the paper inside the tray drawer 120 from outside. The indicating portion 1231*b* slides upward and downward inside the indicating hole 124*a* to indicate the change in the quantity of the paper loaded on the tray 122.

As indicated in FIG. 3, when the paper P1 has a large quantity, the tray 122 has a low height level and drives the linkage 1232 to rotate and raise the height level of the indicator 1231 to indicate that the tray 122 has a large quantity of paper.

As indicated in FIG. 3, the indicator 1231 has a groove 1231*r*; the linkage 1232 includes a slider 1236; the slider 1236 is connected to or disposed at the first end 1233 of the linkage 1232 and can be slidably connected to the groove

1231*r*. The groove 1231*r* provides an allowable displacement along the sliding direction of the tray drawer 120 such as the X axis. For example, the length of the groove 1231*r* along the sliding direction of the tray drawer 120 is larger than the outer diameter of the slider 1236, such that the slider 1236 can slide within the groove 1231*r*. During the adjustment of the height level of the tray 122, the linkage 1232 and the indicator 1231 will move with respect to each other. Since the slider 1236 can slide within the groove 1231*r*, the indicator 1231 and the linkage 1232 will not be over-engaged (that is, the indicator 1231 and the linkage 1232 will not get stuck).

Figure 4:
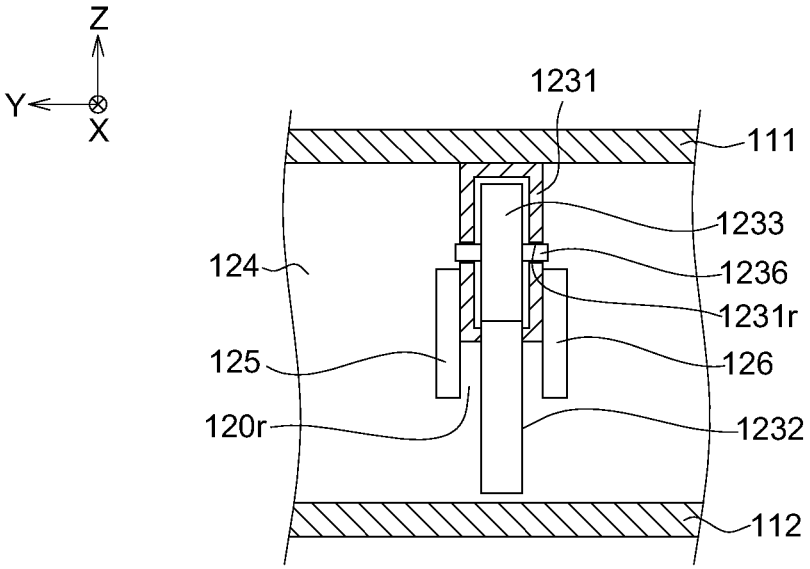
FIG. 4 is a schematic diagram of the tray drawer of FIG. 3 viewed along the +X axis.

Referring to FIG. 4, a schematic diagram of the tray drawer 120 of FIG. 3 viewed along the +X axis is shown (the tray 122 is not illustrated). The tray drawer 120 includes an upper stopper 111 and a lower stopper 112. The indicator 1231 can slide between the upper stopper 111 and the lower stopper 112. The upper stopper 111 can determine the upper limit of the indicator 1231. For example, the larger the quantity of the paper loaded on the tray 122, the higher the indicator 1231. When the indicator 1231 is stopped by the upper stopper 111, this implies that the tray 122 is full or has a large paper quantity.

As indicated in FIG. 4, the tray drawer 120 includes a front plate 124, a first limiting portion 125 and a second limiting portion 126. The first limiting portion 125 and the second limiting portion 126 are disposed on the front plate 124. The indicator 1231 can be slidably disposed between the first limiting portion 125 and the second limiting portion 126. A slide groove 120*r* is formed between the first limiting portion 125 and the second limiting portion 126, and the indicator 1231 can be slidably disposed within and guided by the slide groove 120*r*.

The second end 1234 of the linkage 123 is connected to the tray 122. The linkage 123 has a fulcrum for actuation, wherein the fulcrum is closer to the slider 1236 than the second end 1234. Let FIG. 3 be taken for example. The linkage 123 further includes a pivotal connecting portion 1235 used as the fulcrum, wherein the pivotal connecting portion 1235 is closer to the first end 1233 than the second end 1234. The pivotal connecting portion 1235 pivotally connects a lateral plate 1211 of the drawer body 121 (the lateral plate 1211 is illustrated in FIG. 2), so that the linkage 123 will not come off the drawer body 121. During the upward or downward movement of the tray 122, the linkage 123 rotates around the pivotal connecting portion 1235 but does not translate horizontally or vertically. In an embodiment, the linkage 123 can dispense with the pivotal connecting portion 1235 or dispense with the first limiting portion 125 and the second limiting portion 126. In other words, the linkage 123 can stably move with respect to the drawer body 121 through the pivotal connecting portion 1235 and/or the limiting portion (such as the first limiting portion 125 and the second limiting portion 126).

As indicated in the enlarged view of FIG. 3, the first end 1233 of the linkage 123 is such as a cam having multiple interconnected abutting surfaces 1233*s*. During the upward or downward movement of the tray 122, the corresponding abutting surface 1233*s* can press the surface 1231*s* of the indicator 1231, or the connection between two adjacent abutting surfaces 1233*s* (such as a corner or a spike) can press the surface 1231*s* of the indicator 1231. The surface 1231*s* and the abutting surface 1233*s* can be two surfaces, such as two planar surfaces or two curved surfaces. In an embodiment, the surface 1231*s* and the abutting surface 1233*s* can both be a planar surface or a curved surface. Or, the surface 1231*s* is one of the planar surface and the curved surface, and the abutting surface 1233*s* is the other of the planar surface and the curved surface.

Figure 5:
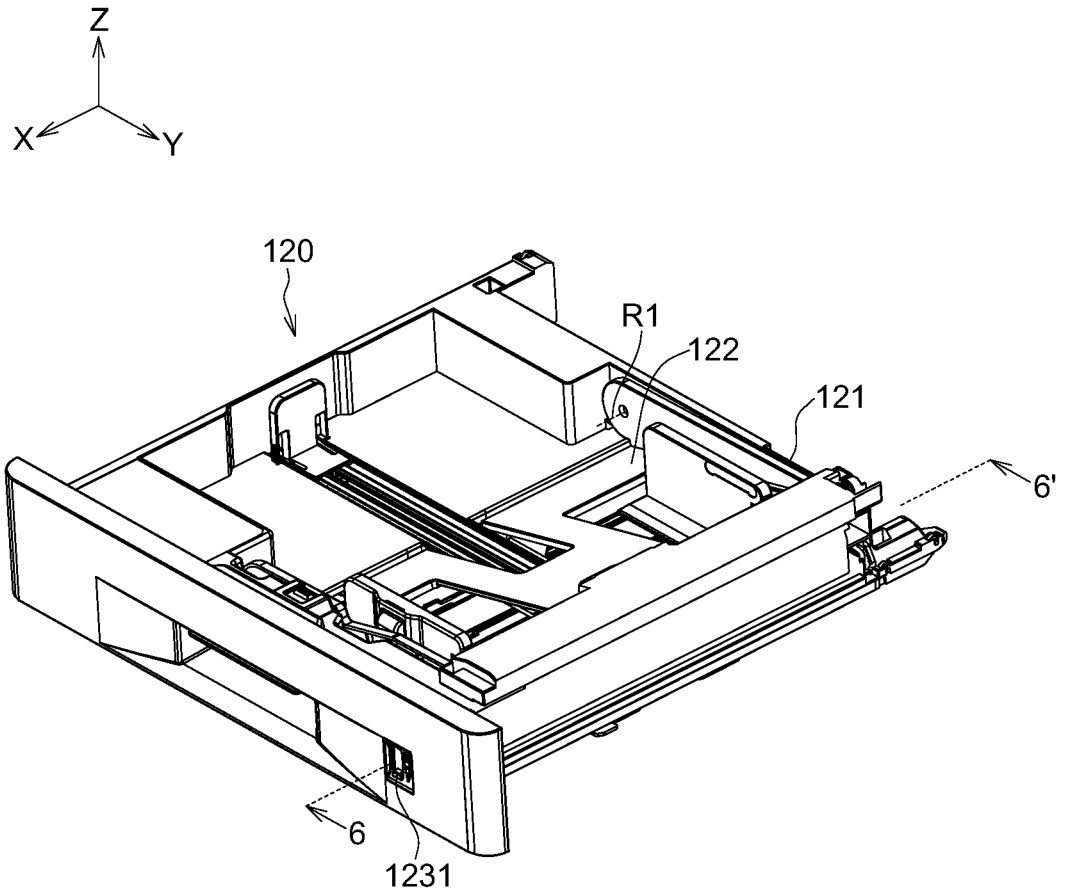
FIG. 5 is a schematic diagram of the indicator of the tray drawer of FIG. 6 indicating a low quantity.
Figure 6:
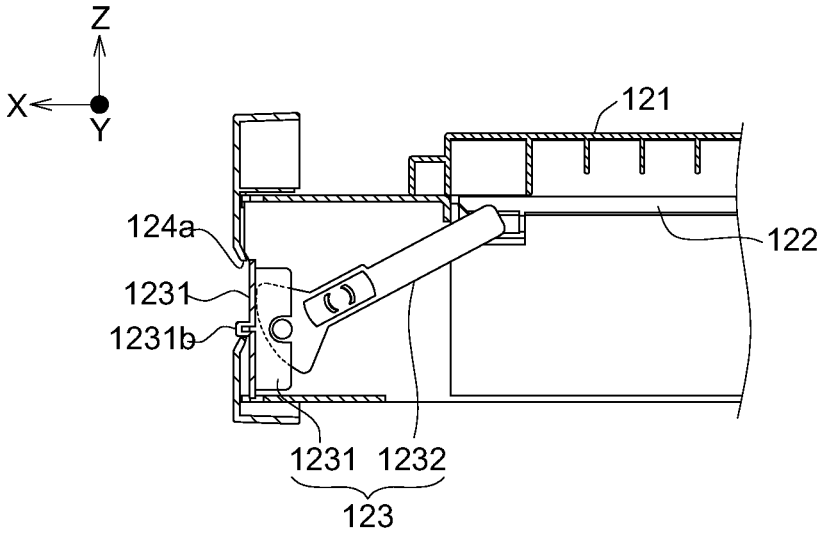
FIG. 6 is a cross-sectional view of the tray drawer of FIG. 5 along a direction 6-6'.
Figure 7:
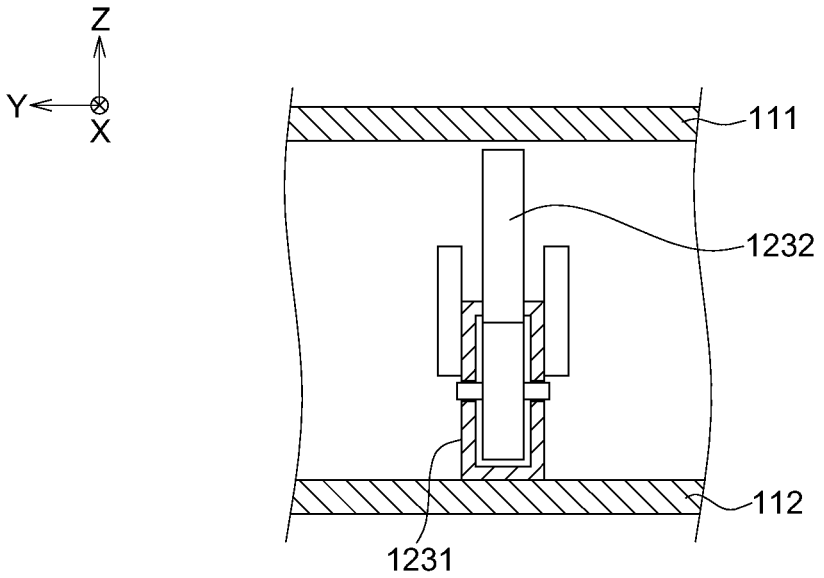
FIG. 7 is a schematic diagram of the indicator of FIG. 4 being stopped by the lower stopper.

Refer to FIGS. 5~7. FIG. 5 is a schematic diagram of the indicator 1231 of the tray drawer 120 of FIG. 6 indicating a low quantity. FIG. 6 is a cross-sectional view of the tray drawer 120 of FIG. 5 along a direction 6-6'. FIG. 7 is a schematic diagram of the indicator 1231 of FIG. 4 being stopped by the lower stopper 112.

As indicated in FIGS. 5 and 6, when the quantity of the paper loaded on the tray 122 decreases, the tray 122 will be raised and drive the linkage 1232 to rotate and lower the height level of the indicator 1231 to indicate the paper quantity. In other words, as the height level of the tray 122 of the embodiments of the invention varies with the quantity of the paper P1 loaded on the tray 122, the height level of the indicator 1231 accordingly changes to indicate the paper quantity of the tray 122. Therefore, the user can know the quantity of the paper within the tray drawer 120 through the height level of the indicator 1231 without having to wait for the paper quantity to be shown on the display of the multi-function printer 100.

As indicated in FIG. 7, when the quantity of the paper loaded on the tray 122 decreases, the indicator 1231 moves downwards. The lower stopper 112 can determine the lower limit of the indicator 1231. For example, the smaller the quantity of the paper loaded on the tray 122, the lower the indicator 1231. When the indicator 1231 is stopped by the lower stopper 112, this implies that the tray 122 has run out of the paper.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A tray drawer, comprising:
a drawer body;
a tray disposed within the drawer body;
a front plate;
a first limiting portion;
a second limiting portion; and
an indicating mechanism, comprising:
an indicator having a groove; and
a linkage pivotally connecting the indicator and the tray, and comprising a slider slidably connected to the groove, wherein a first end of the linkage is a cam having a plurality of interconnected abutting surfaces, and each of the abutting surfaces presses a surface of the indicator in turn when the tray moves upwardly and downwardly;
wherein the first limiting portion and the second limiting portion are disposed on the front plate, and the indicator is slidably disposed in a space between the first limiting portion and the second limiting portion.

2. The tray drawer according to claim 1, wherein the linkage pivotally connects the indicator and a lateral surface of a front end of the tray.

3. The tray drawer according to claim 1, wherein the tray has a rear end pivotally connecting the drawer body.

4. The tray drawer according to claim 1, wherein the tray drawer comprises an upper stopper and a lower stopper, and the indicator slides between the upper stopper and the lower stopper.

5. A multi-function printer, comprising:

a printer body; and a tray drawer according to claim 1 disposed within the printer body.

6. The multi-function printer according to claim 5, wherein the tray has a rear end pivotally connecting the drawer body.

7. The multi-function printer according to claim 5, wherein the tray drawer comprises an upper stopper and a lower stopper, and the indicator slides between the upper stopper and the lower stopper.

8. A tray drawer, comprising:

a tray;

a front plate;

a first limiting portion;

a second limiting portion; and an indicating mechanism for displaying a height level of an end of the tray, wherein the indicating mechanism comprises:

an indicator having a groove;

a linkage comprising a first end and a second end, wherein the first end of the linkage is a cam having a plurality of interconnected abutting surfaces, and each of the abutting surfaces presses a surface of the indicator in turn when the tray moves upwardly and downwardly; and a slider connected to the first end of the linkage and slidably connected to the groove;

wherein the second end of the linkage is connected to the tray, and the linkage has a fulcrum for actuation closer to the slider;

wherein the first limiting portion and the second limiting portion are disposed on the front plate, and the indicator is slidably disposed in a space between the first limiting portion and the second limiting portion.

* * * * *